US010280811B2

(12) United States Patent
Duel

(10) Patent No.: US 10,280,811 B2
(45) Date of Patent: May 7, 2019

(54) VALVE TRAIN SYSTEM

(71) Applicant: Steve James Duel, Saginaw, MI (US)

(72) Inventor: Steve James Duel, Saginaw, MI (US)

( * ) Notice: Subject to any disclaimer, the term of this patent is extended or adjusted under 35 U.S.C. 154(b) by 208 days.

(21) Appl. No.: 15/084,550

(22) Filed: Mar. 30, 2016

(65) Prior Publication Data

US 2017/0284234 A1 Oct. 5, 2017

(51) Int. Cl.

| | |
|---|---|
| ***F01L 1/34*** | (2006.01) |
| ***F01L 1/047*** | (2006.01) |
| ***F01L 1/12*** | (2006.01) |
| ***F01L 1/18*** | (2006.01) |
| ***F01L 1/30*** | (2006.01) |

(52) U.S. Cl.

CPC ..... *F01L 1/047* (2013.01); *F01L 1/12* (2013.01); *F01L 1/18* (2013.01); *F01L 1/30* (2013.01)

(58) Field of Classification Search

CPC ..... F01L 1/12; F01L 1/30; F01L 1/047; F01L 1/18

USPC ..... 123/90.12, 90.16, 90.65

See application file for complete search history.

*Primary Examiner* — Ching Chang

(57) ABSTRACT

A valve train system that eliminates the inefficiencies of current spring biased systems. The system uses teeter beams that are manipulated by cams that are driven by cam shafts to control and operate the valve system more efficiently and dependably.

3 Claims, 10 Drawing Sheets

VALVE TRAIN SYSTEM

BACKGROUND OF THE INVENTION

The present invention is a valve train system. It has been discovered that current push rod valve train systems are extremely inefficient and unreliable at high RPM because floating occurs and allowing the valve to be neither open nor closed. Also valve bounce will occur. These current systems are prone to spring failure and lifter collapse. The present invention eliminates all of these problems.

Current push rod valve train systems do not allow for cam extreme dynamics. Push rod valve train systems have great inefficiencies that result from the use of springs in the systems. It has been discovered that the present invention uses a system where each movement has a counter movement and the system is in true balance. There is force and counterforce, not excessive force, which leads to constant balance. With the instant system there is an action and counteraction leading to balance.

It has been discovered that this overall balance in the valve train system has achieved a greater utility over conventional spring biased systems.

THE INVENTION

The present invention is a valve train system for internal combustion engines. The valve train system comprises in combination a teeter beam that has a near end and a distal end. The distal end of the teeter beam has a concavity in an upper surface thereof and the distal end has rotatably mounted thereon a first roller bearing. The teeter beam is pivotally mounted at a center point of the teeter beam, on a rigidly affixed post, this pivotal mounting is tunable.

The near end of the teeter bar comprises a grooved driver head. There is a second roller bearing rotatably mounted on the teeter beam at a point between the pivotal mount and the grooved driver head, and on a top surface of the teeter beam.

There is a grooved cylinder valve stem control interfacing with and integrated with the grooved driver head such that when the grooved driver head moves, the grooved cylinder valve stem controller moves therewith. The grooved cylinder valve stem controller has a retainer at a distal end of the grooved cylinder valve stem controller. The grooved cylinder valve stem controller is confined by a back stop retainer guide. The back stop container guide has a channel in a front surface thereof, a forward side of the grooved cylinder valve stem controller has a ridge thereon. This ridge slidably fits into the channel.

There is a bearing journal. The bearing journal contains a first cam gear mounted therein. The cam gear has a shaft. This shaft has mounted on a distal end, a primary cam anti-lobe. The primary cam anti-lobe interfaces with and periodically touches the first roller bearing.

There are at least two second cam gears that have shafts and mounted on the second cam gear shafts are the secondary cams. The secondary cams interface with, and periodically touch, the roller bearing and there is reciprocally, internally mounted in the grooved cylinder valve stem controllers, valve stems. The valve stems have a valve mounted on, and at a base, of the valve stems. The cam gears are configured to drive in the same rotational direction, and there is a spring mounted over the valve stem for providing spring tension on the valve stem.

There is another embodiment wherein there is a hydraulic lifter for a vehicle engine. The hydraulic lifter comprises an upper canister. This upper canister has an upper end and a lower end. There is a snap ring groove located in an inside wall of the upper end.

There is also a lower canister. The upper canister is moveable within a wall of the lower canister and there is a first opening through the wall of the lower canister.

There is a stem of a poppet valve that is moveable through a center point of the lower canister. The poppet valve stem extends through a center point in the upper canister. The upper canister is attached to the poppet valve stem by a fastening means that is a spring. The spring is located in the lower canister. The spring surrounds the poppet valve stem. The lower canister has attached to an outside surface, a lifter guide.

The lower canister has attached to the outside surface, opposite the lifter guide, a cylinder valve controller.

The lifter guide has a second opening therethrough to pass hydraulic fluid into the lower canister. The second opening is aligned with the first opening. The upper canister has a fluid exit port through a wall thereof.

DETAILED DESCRIPTION OF THE DRAWINGS

The present invention is a valve train system for internal combustion engines. The terms primary cam and recessed cam are interchangeable. The terms secondary cam and process cam are also interchangeable. The term "wedge" is used to describe a standard production style head configuration 162. The term Hemi is used to describe a hemispherical combustion chamber and a type of combustion chamber with a domed cylinder head. The head 164 of a hemi is configured differently. RPM is understood to mean revolutions per minute.

Figure 1:
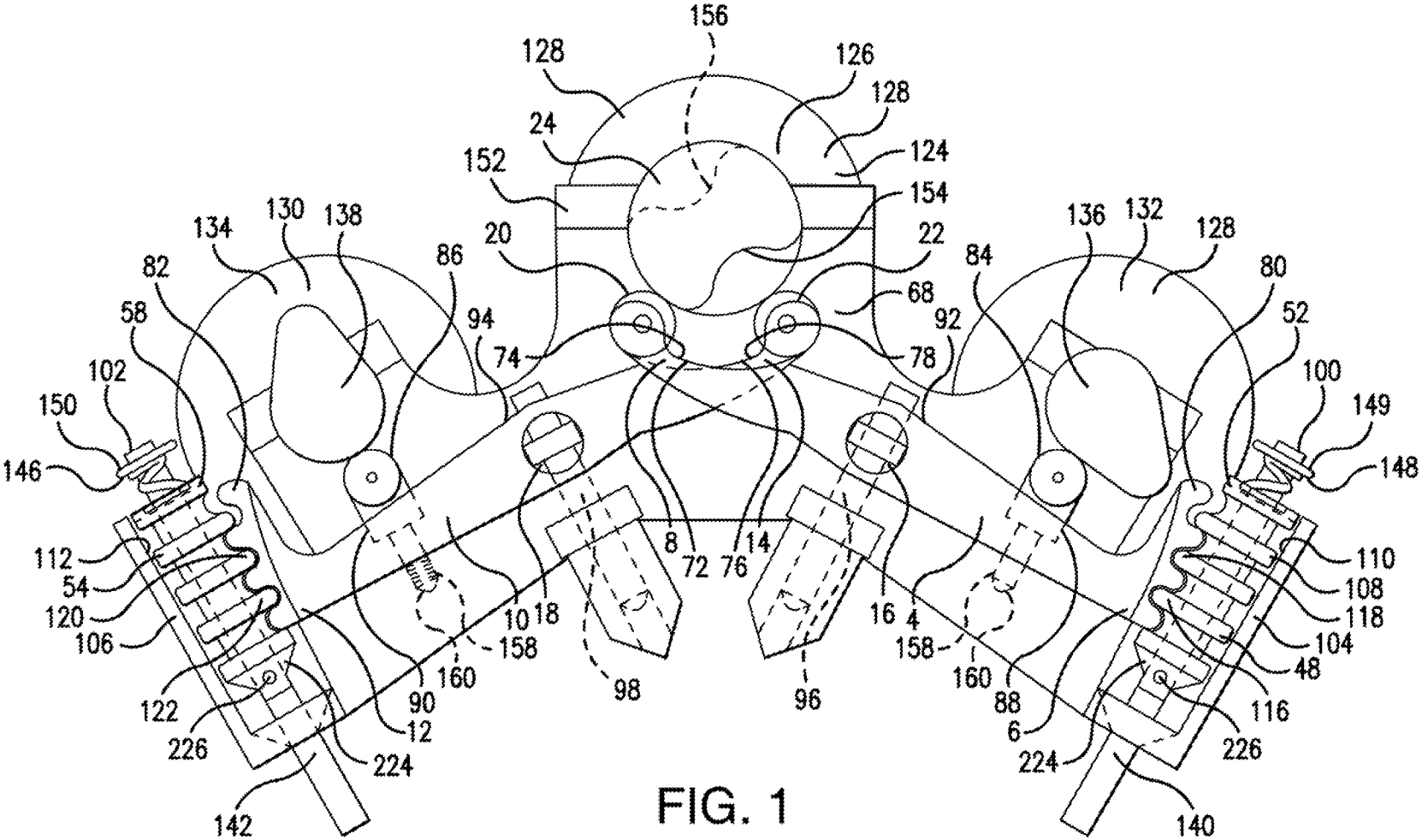
FIG. 1 shows the engine component.

FIG. 1 shows the valve train system 2. The present invention is a valve train system 2 for internal combustion engines. The valve train system 2 comprises in combination a first teeter beam 4 that has a near end 6 and a distal end 8. The distal end 8 of the first teeter beam 4 has a concavity 72 in an upper surface 74 thereof and the distal end 8 has rotatably mounted thereon a first roller bearing 20.

The valve train system 2 comprises in combination a second teeter beam 10 that has a near end 12 and a distal end 14. The distal end 14 of the second teeter beam 10 has a concavity 76 in an upper surface 78 thereof and the distal end 14 has rotatably mounted thereon a second roller bearing 22. The teeter beams 4 and 10 are pivotally mounted at center points 16 and 18 of the teeter beams 4 and 10. These center points are also called pivotal teeter bar mounts.

Each teeter beam 4 and 10 are mounted on rigidly affixed posts 96 and 98 respectively. These pivotal mountings are tunable.

The near end 6 of the first teeter beam 4 comprises a grooved driver head 80. There is an another roller bearing 84 rotatably mounted on the first teeter beam 4 at a point between the pivotal mount 88 and the grooved driver head 80, and on a top surface 92 of the teeter beam 4.

The near end 12 of the second teeter beam 10 comprises a grooved driver head 82. There is an another roller bearing 86 rotatably mounted on the second teeter beam 10 at a point between the pivotal mount 90 and the grooved driver head 82, and on a top surface 94 of the teeter beam 10.

The first teeter bar 4 has a grooved cylinder valve stem controller 54 interfacing with and integrated with the grooved driver head 82 such that when the grooved driver head 82 moves, the grooved cylinder valve stem controller 54 moves therewith. The grooved cylinder valve stem controller 48 has a retainer 58 at a distal end 102 of the grooved cylinder valve stem controller 48. The grooved cylinder valve stem controller 48 is confined by a back stop retainer guide 106. The back stop retainer guide 106 has a channel 114 in a front surface 112 thereof, the forward side 120 of the grooved cylinder valve stem controller 48 has a ridge 122 thereon. This ridge 122 slidably fits into the channel 114.

The second teeter bar 10 has a grooved cylinder valve stem control 54 interfacing with and integrated with the grooved driver head 82 such that when the grooved driver head 82 moves, the grooved cylinder valve stem controller 54 moves therewith. The grooved cylinder valve stem controller 82 has a retainer 58 at a distal end 102 of the grooved cylinder valve stem controller 54. The grooved cylinder valve stem controller 54 is confined by a back stop retainer guide 106. The back stop container guide 106 has a channel 114 in a front surface 112 thereof, the forward side 120 of the grooved cylinder valve stem controller 54 has a ridge 122 thereon. This ridge 122 slidably fits into the channel 114.

There is a bearing journal 68. The bearing journal 68 contains a first cam gear 128 mounted therein. The cam gear 128 has a shaft 124. This shaft 124 has mounted on a distal end 126, a primary cam anti-lobe 24. The primary cam anti-lobe or recessed cam 24 interfaces with and periodically touches the roller bearing 20 and journal bearing 152. The primary cam anti-lobe 24 has a frontal anti-lobe 154 and a reward anti-lobe 156 shown in phantom. The roller bearing 20 interacts with the frontal anti lobe 154 and the roller bearing 22 interacts with the reward anti-lobe 156. The primary cam 24 will seat the valve on the first portion of rotation and will aid in recovery on the remained of the rotation.

There are two secondary cam gears 128 and 130 that have shafts 132 and 134. Mounted on the second cam gear shafts 132 and 134 are the secondary cams 136 and 138. The secondary cams or process cams 136 and 138 interface with and periodically touch the roller bearings 84 and 86 and there is reciprocally, internally mounted in the grooved cylinder valve stem controllers 48 and 54, and valve stems 140 and 142. The valve stems 140 and 142 have a wide section mounted on and at a base of the valve stems 140 and 142.

The cam gears 128 and 130 are configured to drive in the same rotational direction. Springs 144 and 146 mounted over the valve stems 140 and 142 provide spring tension on the valve stems 140 and 142.

There are pivotal bearing mounts 88 and 90, respectively, for the teeter beams 4 and 10 that have a fastener 160 to lock them into place, and shown is a set screw 160 that travels up into the threaded bolt 158 expanding it and locking it into place.

There is a value stem retainer 224 and valve stem retainer set screw 226 to lock it into place. When the valve 60 moves upward to seat, it puts pressure on the spring 144. This helps to maintain force to keep the valve seated. The valve stem retainer 224 is secured to the valve stem 140 via the valve stem retainer set screw 226.

Figure 2:
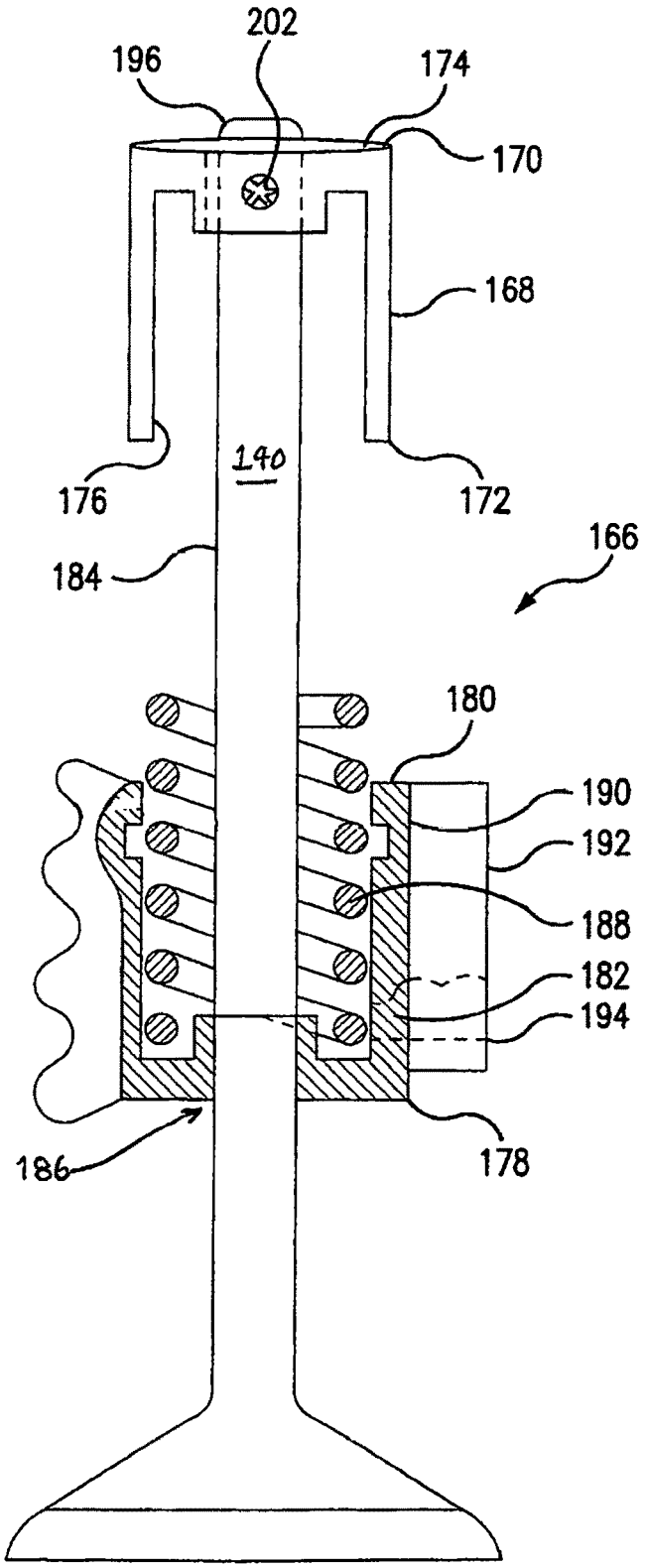
FIG. 2 shows the valve system being controlled hydraulically.

FIG. 2 shows the valve stem 2 being controlled hydraulically. This embodiment has a hydraulic controller 166 for a vehicle engine. The hydraulic controller 166 comprises an upper canister 168. This upper canister 168 has an upper end 170 and a lower end 172. There is a snap ring groove 174 located in an inside wall 176 of the upper end 170.

There is also a lower canister 178. The upper canister 168 is moveable within a wall 180 of the lower canister 178 and there is a first opening 182 through the wall 180 of the lower canister 178.

There is a stem 140 of a poppet valve 184 that is moveable through a center point 186 of the lower canister 178. The poppet valve 184 and stem 140 extend through a center point 229 in the upper canister 168. The upper canister 168 is attached to the poppet valve stem 140 by a fastening means, and such means is shown as a set screw 202. The spring 188 is located in the lower canister 178. The spring 188 surrounds the poppet valve stem 140. The lower canister 178 has attached to an outside surface 190, a lifter guide 192.

The lower canister 178 has attached to the outside surface, 190 an opposite lifter guide 192 and a cylinder valve controller. The lifter guide 192 has a second opening 194 therethrough to pass hydraulic fluid into the lower canister 178. The second opening 194 is aligned with the first opening 182. The upper canister 168 has a fluid exit port 196 through a wall 180 thereof.

Figure 3:
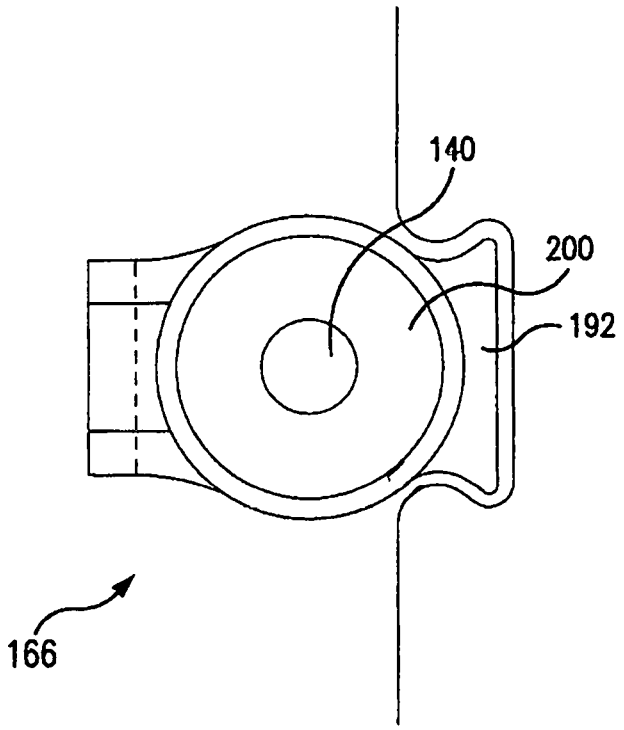
FIG. 3 shows the hydraulic controller from the top.

FIG. 3 shows the hydraulic controller 166 from the top. Also shown is the lifter guide 192. The valve stem 140 is shown as well as the snap ring 200.

FIGS. 2 and 3 represent a hydraulically controlled system. They are the only embodiments that have this feature. All other features are mechanically controlled.

Figure 4:
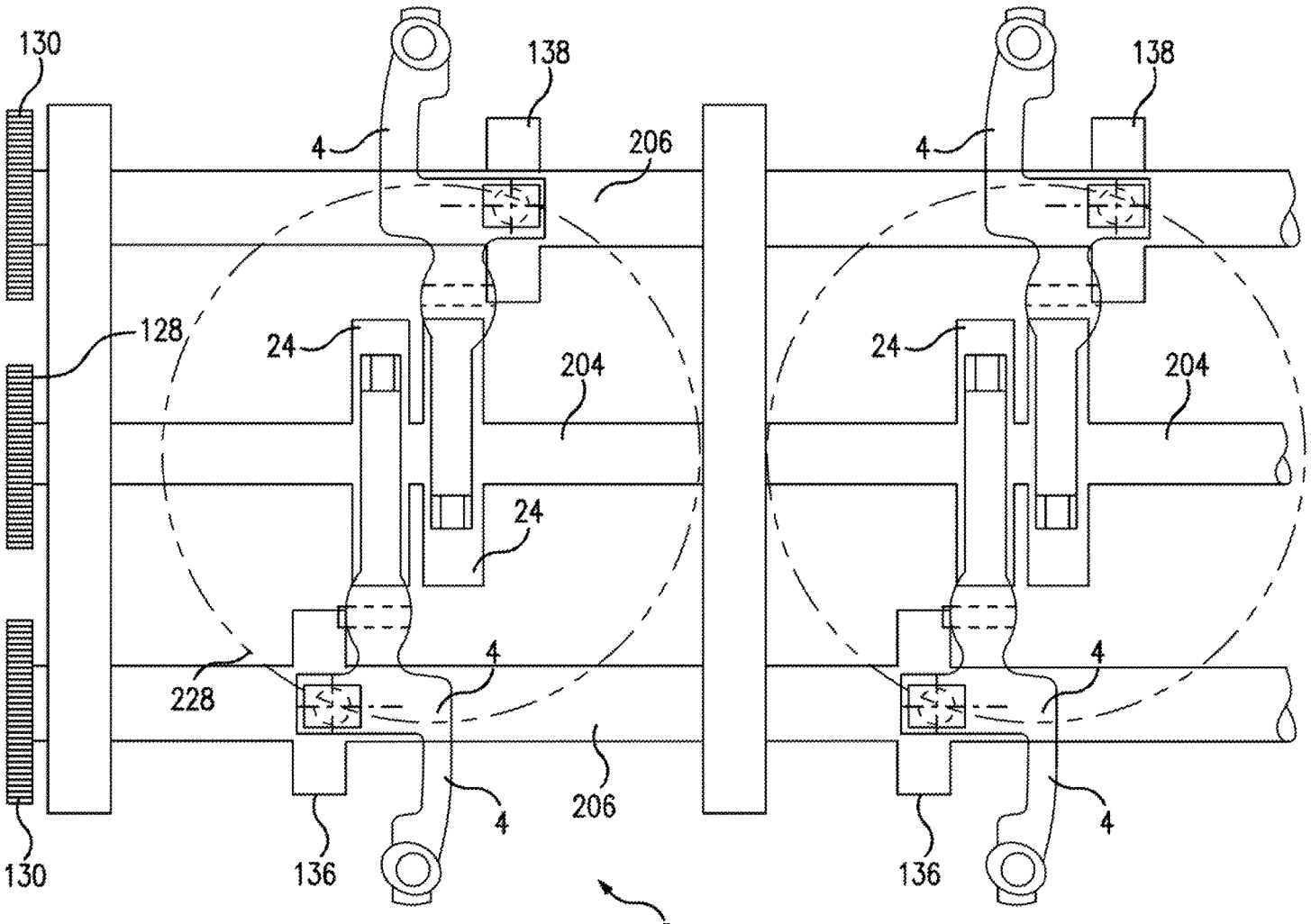
FIG. 4 shows the valve system from the top.

FIG. 4 shows the valve system 2 from the top. Here it is clear that the primary cam shaft 204 and the secondary cam shaft 206 are driven by the primary or first cam gear 128 and the secondary or second cam gear 130. These cam shafts 204 and 206 drive the primary cam 24, the first secondary cam 136 and the second secondary cam 138. Also shown is the cylinder bore 228.

Figure 5:
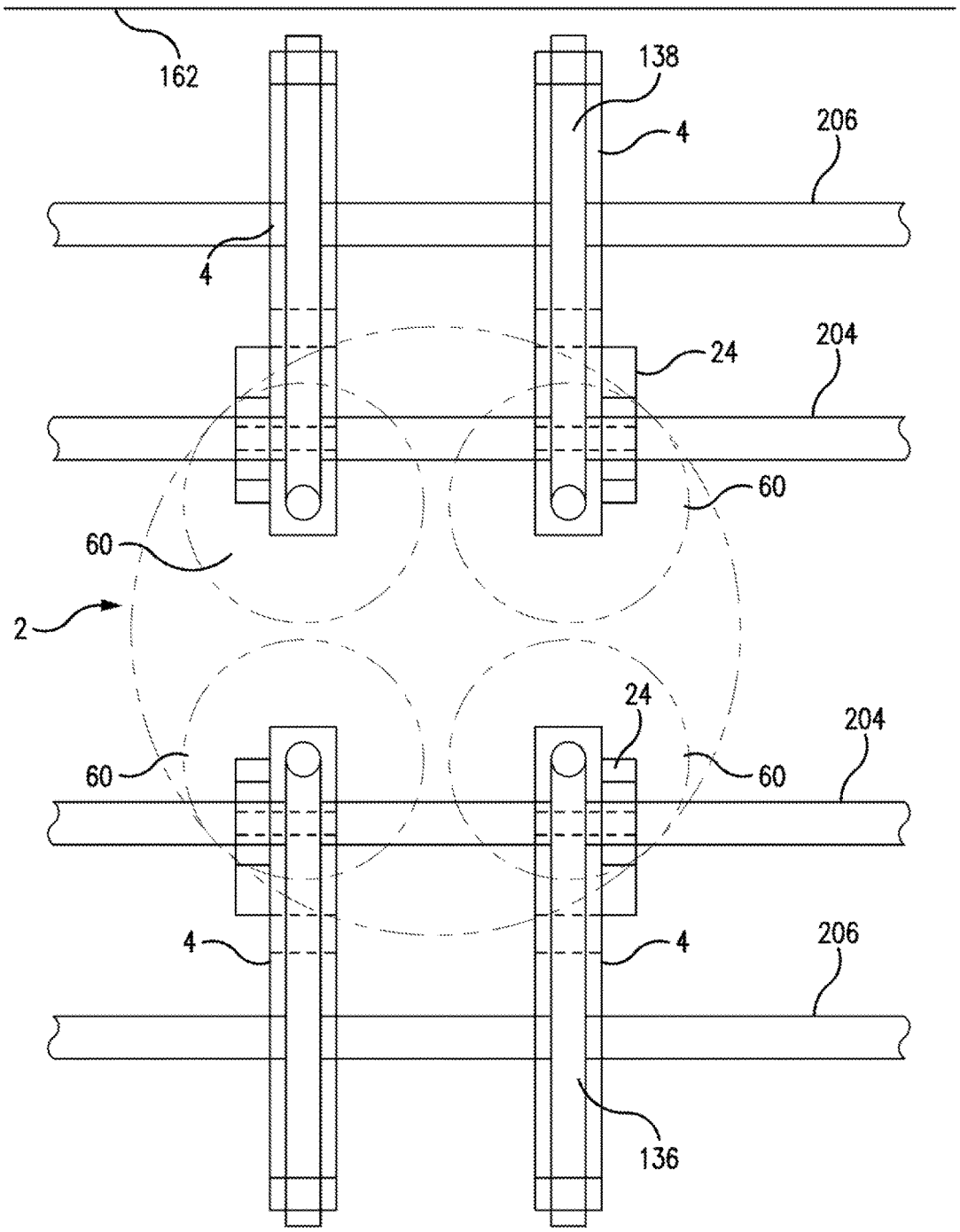
FIG. 5 shows the valve system from the top.

FIG. 5 shows the valve system 2 from the top. This embodiment has a four valve set up 60. Four valves require four teeter beams 4 to operate each valve 60. This is the typical wedge type head 162. This embodiment uses a four cam shaft configuration. The primary cam shafts 204 and recess lobe 24 are present. The secondary cam shafts 206 and process cams 136 and 138 are also shown.

Figure 6:
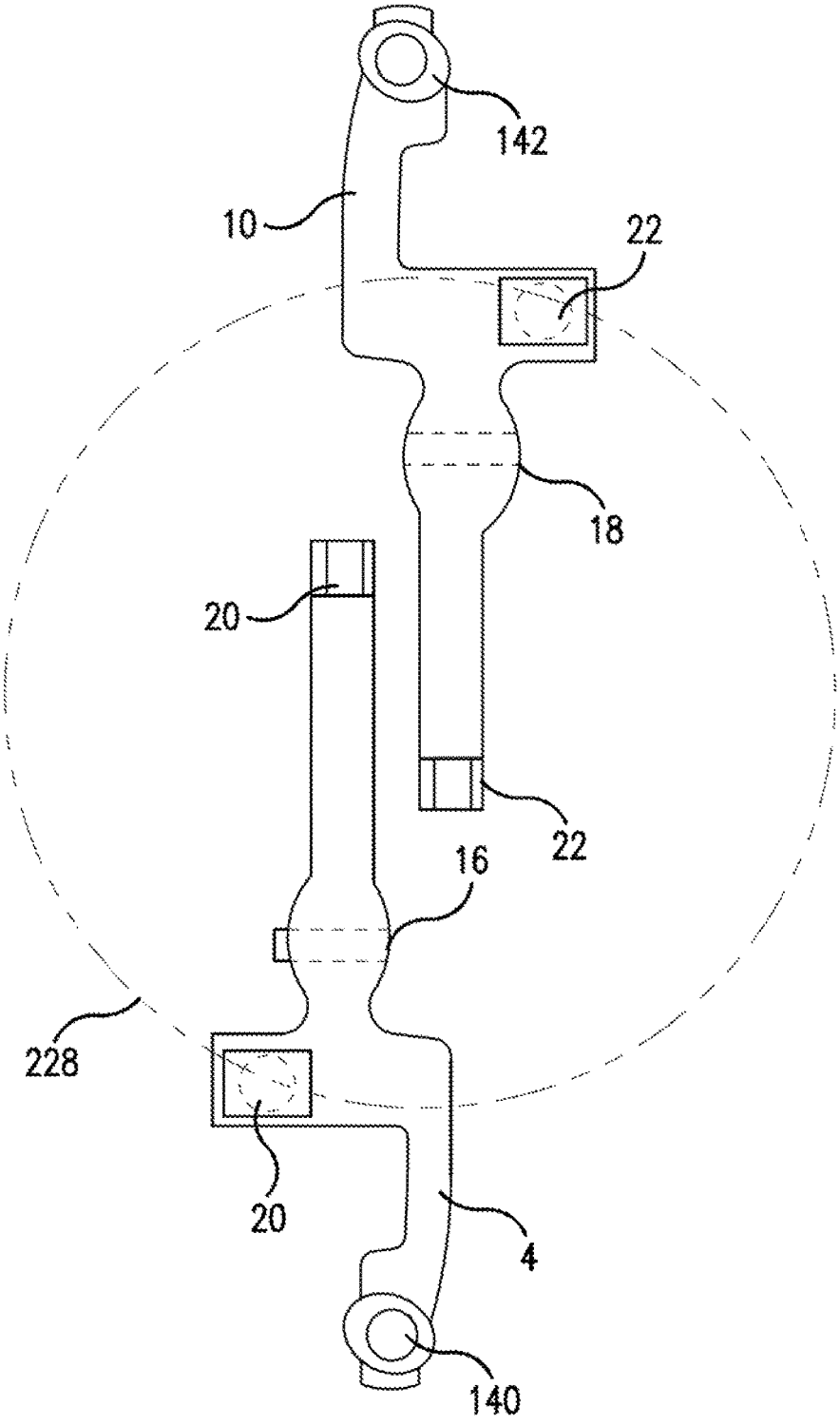
FIG. 6 shows the teeter beam configuration for a hemi engine.

FIG. 6 shows the teeter beam 4 and 10 configuration for a hemi over the cylinder bore 228. The first teeter beam 4 has a valve stem 140, a roller bearing 20 for the secondary cam 136. The teeter beam 4 is pivotally mounted at a center point or midpoint 16. Also shown is the roller bearing 20 for the primary cam 24.

The second teeter beam 10 has a valve stem 142 and a roller bearing 22 for the secondary cam 138. The teeter beam 10 is pivotally mounted at a center point 18. Also shown is the roller bearing 22 for the primary cam 24.

Figure 7:
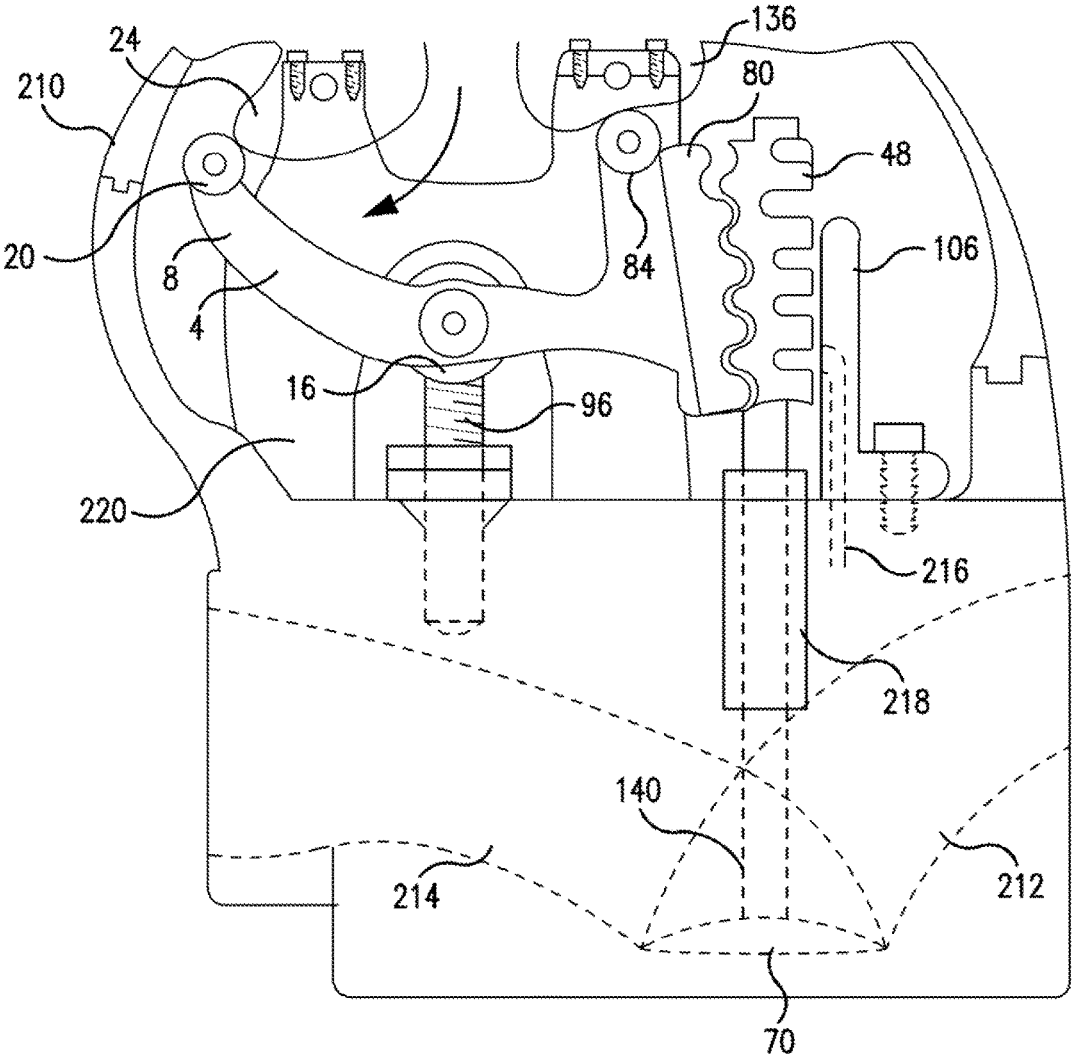
FIG. 7 shows the valve system from the front for a wedge style head.

FIG. 7 shows the valve system from the front for a wedge style engine head. The valve cover 210 has a unique shape to allow the valve system 2 to fit within it. This embodiment shows the air intake port 212 and the exhaust port 214. Also shown is the oil feed port 216. This view shows the valve guide 218. The cam journal 220 that holds the cam shafts 204 and 206 in place is also shown. The back stop 106 helps guide the up and down motion of the grooved cylinder valve stem controller 48.

The near end 6 of the first teeter beam 4 comprises a grooved driver head 80. There is an another roller bearing 84 rotatably mounted on the first teeter beam 4 at a point between the pivotal mount 88 and the grooved driver head 80, and on a top surface 92 of the teeter beam 4.

Figure 8:
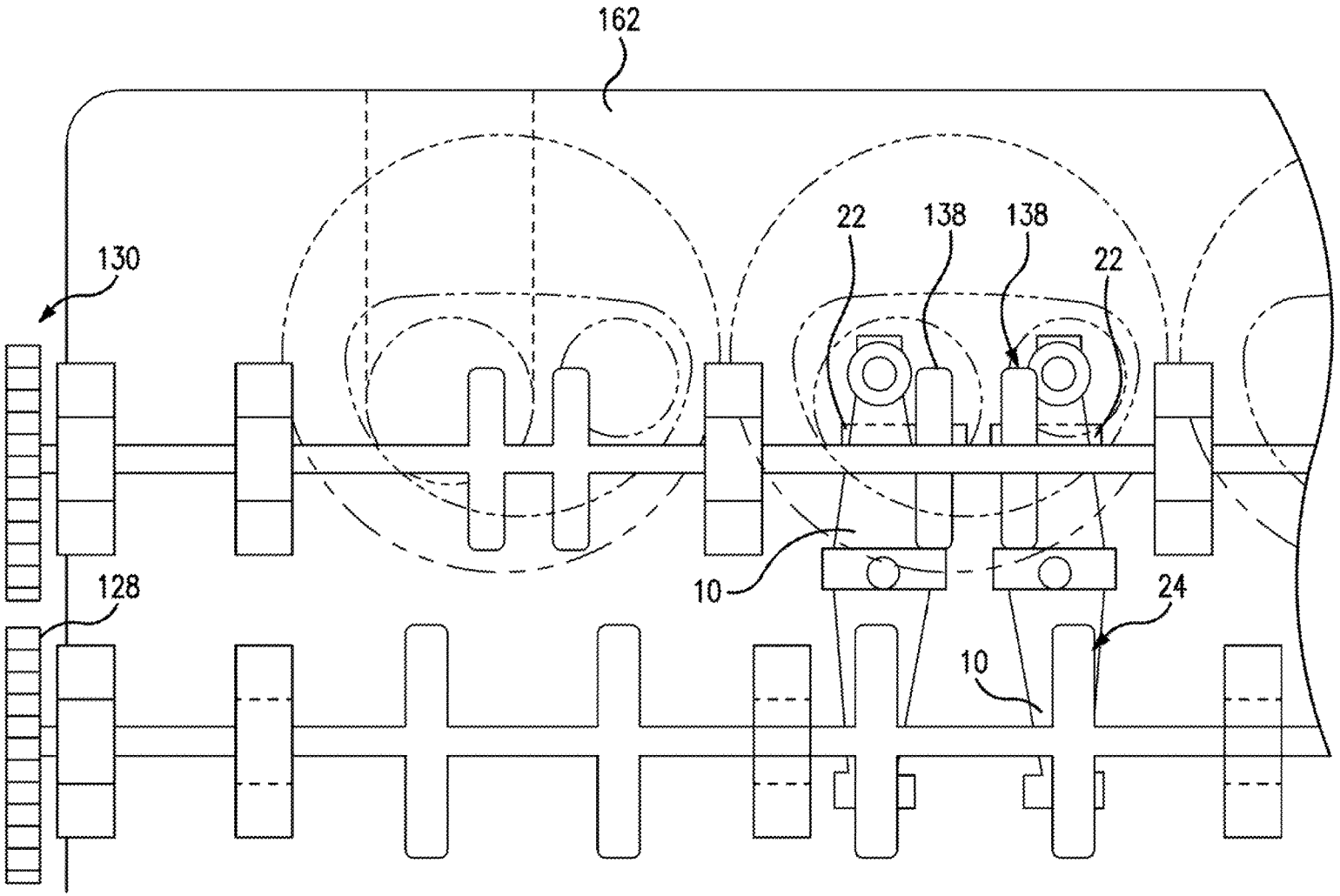
FIG. 8 shows staggered bearing surfaces.

FIG. 8 shows staggered bearing surfaces 22. The staggering of the bearings 22 allows for staggering the secondary cam lobes 138 which brings the cams 138 closer together, therefore shortening the lift stroke forcing the lifters to lift faster, which results in the ability to operate at higher RPM for higher performance. Reducing the size of the entire head 162 saves space and improves performance. The teeter beams 10 are significantly shorter as well.

Staggering refers to extending the roller bearings 22 so they stick out of the plane of the teeter bearing 10 to make contact with the secondary cam 138.

Figure 9:
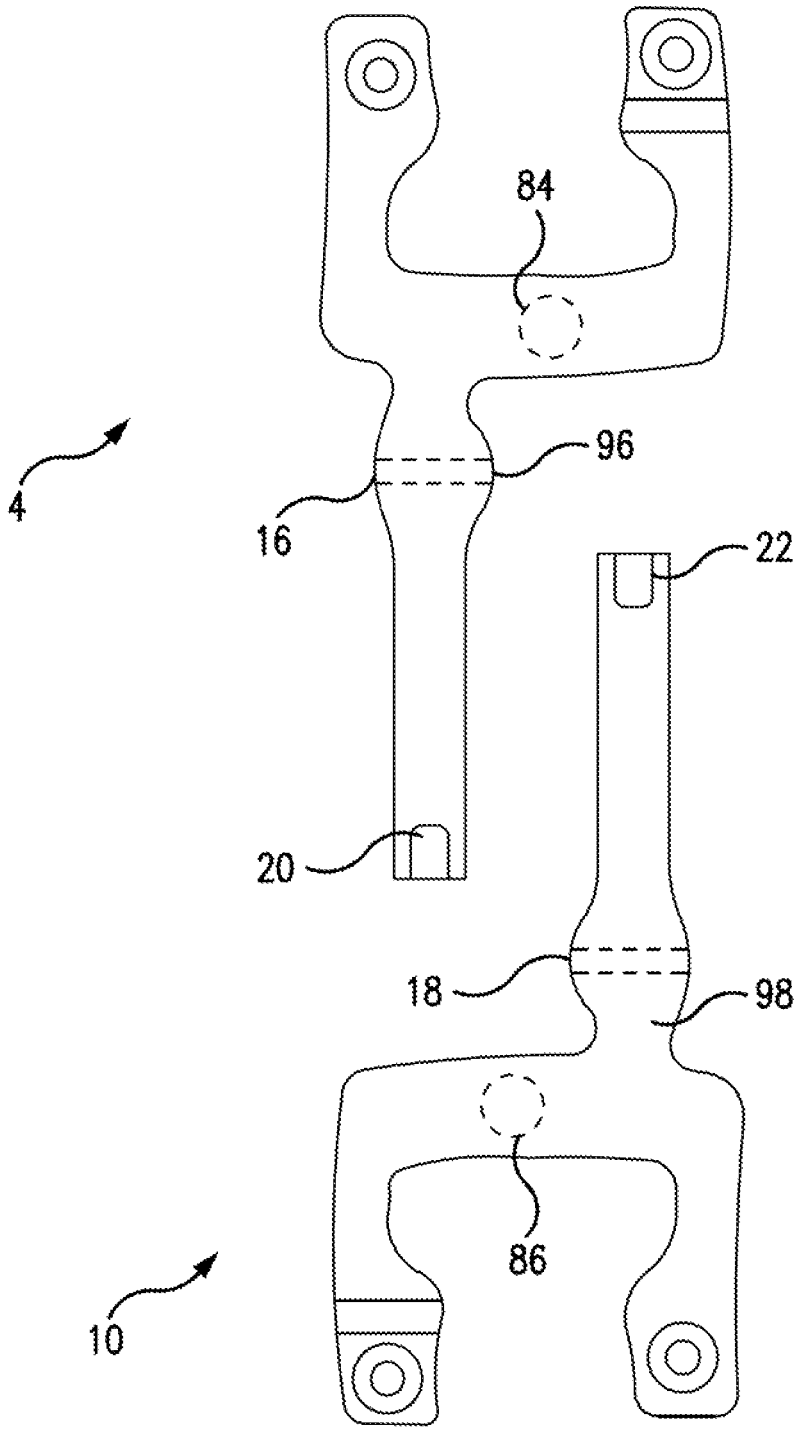
FIG. 9 shows another embodiment wherein the teeter beam has a dual lifter system.

FIG. 9 shows another embodiment wherein the teeter beam 4 is a dual lifter. This embodiment allows the teeter bear 4 to operate two lifters with the work of one. The valve train system 2 comprises in combination a first teeter beam 4 that has a near end 6 and a distal end 8. The distal end 8 of the first teeter beam 4 has a concavity 72 in an upper surface 74 thereof and the distal end 8 has rotatably mounted thereon a first roller bearing 20.

The valve train system 2 comprises in combination a second teeter beam 10 that has a near end 12 and a distal end 14. The distal end 14 of the second teeter beam 10 has a concavity 76 in an upper surface 78 thereof and the distal end 14 has rotatably mounted thereon a second roller bearing 22. The teeter beams 4 and 10 are pivotally mounted at center points 16 and 18 of the teeter beams 4 and 10. Each teeter beam 4 and 10 is mounted on a rigidly affixed post 96 and 98, respectively. These pivotal mountings are tunable.

Figure 10:
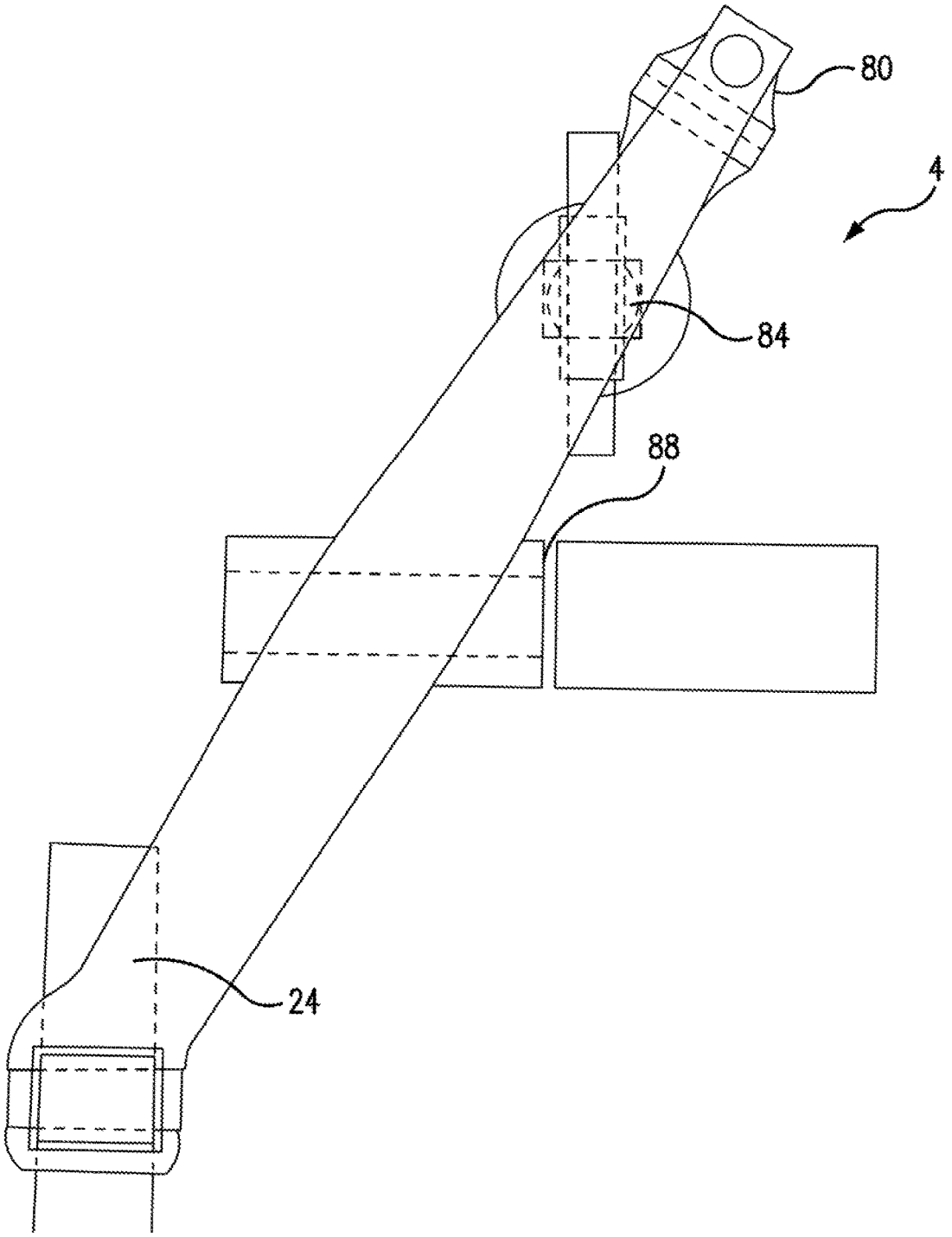
FIG. 10 shows another embodiment wherein the teeter beam is angled.

FIG. 10 shows another embodiment where the teeter beam is angled. This embodiment angles the teeter beam 4 for space accommodation. If the teeter beam 4 has an angle it reduces the amount of space needed within the valve cover 210.

The near end 6 of the first teeter beam 4 comprises a grooved driver head 80. There is an another roller bearing 84 rotatably mounted on the first teeter beam 4 at a point between the pivotal mount 88 and the grooved driver head 80, and on a top surface 92 of the teeter beam 4.

It should be clear that each teeter beam 4 and 10 operates a single valve 60. Each cylinder 208 has at least one valve 60. To extrapolate further, if a cylinder has two valves 60 then it will require two teeter beams 4. If the cylinder 208 has four valves it will require four teeter beams 4. The exception to one valve per teeter beam 4 and 10 is the embodiment noted in FIG. 8 where the teeter beam 4 and 10 have dual lifter capabilities.

This valve 60 configuration is a single cylinder set up and will extrapolate out to how many other cylinders each engine has.

When using the term tunable the applicant is referring to clearance adjustments.

The valve train system 2 is operated by cam shafts 132 and 134 that are driven by cam gears 128 and 130. The system requires at least one cam shaft to operate. Most applications require two cam shafts to operate, however, three cam shafts are required for Hemi engine blocks and at least four cam shafts are required to operate high end, high performance racing applications.

The components of the inventive system are manufactured from metals.

What is claimed is:

1. A valve train system for internal combustion engines, said valve train system comprising in combination:

i. a teeter beam having a near end and a distal end, said distal end of said teeter beam having a concavity in an upper surface thereof and said distal end having rotatably mounted thereon a first roller bearing;

ii. said teeter beam being pivotally mounted at a center point of said teeter beam, on a rigidly affixed post, said teeter beam being tunable;

iii. said near end comprising a grooved driver head, there being a second roller bearing rotatably mounted on said teeter beam at a point between said pivotal mounting teeter and said grooved driver head, and on a top surface of said teeter beam;

iv. a grooved cylinder valve stem controller interfacing with and integrated with said grooved driver head such that when the grooved driver head moves, the grooved cylinder valve stem controller moves therewith, said grooved cylinder valve stem controller having a retainer at a distal end of said grooved cylinder valve stem controller, said grooved cylinder valve stem controller being confined by a back stop retainer guide, said back stop retainer guide having a channel in a front surface thereof, a forward side of said grooved cylinder valve stem controller having a ridge thereon, said ridge slidably fitting into said channel;

v. a bearing journal, said bearing journal containing a first cam gear mounted therein, said first cam gear having a shaft, said shaft having mounted on a distal end, a primary cam anti-lobe, said primary cam anti-lobe interfacing with and periodically touching said first roller bearing;

vi. valve stems having a wide section mounted on and at a base of said valve stems;

vii. a spring mounted over a valve stem for providing spring tension on said valve stem.

2. A valve train system for internal combustion engines as claimed in claim 1, wherein said teeter beam has, in addition, at least one grooved driver head.

3. A hydraulic lifter for a vehicle engine, said hydraulic lifter comprising:

i. an upper canister, said upper canister having an upper end and a lower end, there being a snap ring groove located in an inside wall of said upper end;

ii. a lower canister, said upper canister being moveable within a wall of said lower canister and there being a first opening through said wall of said lower canister;

iii. a stem of a poppet valve being moveable through a first center point of said lower canister, said poppet valve stem extending through a second center point in said upper canister, said upper canister being attached to said poppet valve stem by a fastening means;

iv. a spring, said spring being located in said lower canister, said spring surrounding said poppet valve stem;

v. said lower canister having adjoining an outside surface, a lifter guide;

vi. said lower canister having attached to said outside surface, opposite said lifter guide, a cylinder valve controller;

vii. said lifter guide having a second opening therethrough to pass hydraulic fluid into said lower canister, said second opening being aligned with said first opening;

viii. said upper canister having a fluid exit port through a wall in said upper canister.

* * * * *